United States Patent [19]

Prins

[11] 3,938,341

[45] Feb. 17, 1976

[54] STORAGE DEVICE FOR LIQUIDS

[76] Inventor: Theodorus Prins, Rivierdijk 655, Sliedrecht, Netherlands

[22] Filed: June 28, 1972

[21] Appl. No.: 267,037

[30] Foreign Application Priority Data

Aug. 5, 1971 Netherlands ..... 7110804

[52] U.S. Cl. ..... 61/46; 61/1 R; 61/4; 61/30

[51] Int. Cl.[2] .... B65G 5/00; E02B 3/04; E02D 5/00

[58] Field of Search ..... 61/.5, 1 R, 4, 30, 46, 61/32, 81, 46.5; 52/169; 220/85 A

[56] References Cited

UNITED STATES PATENTS

| | | | |
|---|---|---|---|
| 480,127 | 8/1892 | O'Rourke | 61/81 |
| 994,666 | 6/1911 | Bancroft | 61/30 |
| 1,879,836 | 9/1932 | Yale | 61/32 |
| 1,937,781 | 12/1933 | Patton | 61/30 |
| 2,945,465 | 7/1960 | Barton | 61/1 R |
| 2,966,778 | 1/1961 | Quirin | 61/46 |
| 3,347,051 | 10/1967 | Bjerke et al. | 61/50 |
| 3,592,009 | 7/1971 | Alkmaar et al. | 61/.5 |

FOREIGN PATENTS OR APPLICATIONS

| | | | |
|---|---|---|---|
| 281,929 | 12/1927 | United Kingdom | 61/81 |
| 243,956 | 12/1925 | United Kingdom | 61/81 |

OTHER PUBLICATIONS

"Dredged Open Caysons" *Construction Methods*, Aug. 1934, pp. 42–44.

*Primary Examiner*—Jacob Shapiro
*Attorney, Agent, or Firm*—Cushman, Darby & Cushman

[57] ABSTRACT

Storage device for example for natural oil products wherein a dike or dam in a water mass encloses a rectangular area at least partly. In the enclosed area a reservoir is formed which, just like the dam, is composed of contiguous compartments, each compartment being laterally defined by caissons.

5 Claims, 3 Drawing Figures

STORAGE DEVICE FOR LIQUIDS

The invention relates to a storage device for liquids, in particular natural oil products, as well as to a method of manufacturing the storage device.

As a result of the great activity in the field of oil recovery in sea, namely on the continental shelf, but also owing to the ever increasing use of so-called mammoth tankers, there is need for large storage capacity for natural oil products, particularly adjacent important ports of transit. If quantities in the order of 45 million $m^3$ are to be stored conventionally, i.e. in cylindrical metal surface storage tanks, a number of difficulties is experienced, in the first place structurally and further with respect to available areas, which are often in short supply adjacent the above ports of transit or also near refineries, while in the case of explosions the fire hazard in such areas is unallowably great.

The object of the invention is to provide a storage device of the type defined above, which is suitable for very large quantities of oil and which can be manufactured in a simple manner with a minimum number of equal building elements, thereby also avoiding the above drawbacks.

To this end, the storage device according to the invention is characterized by a dike or dam which forms a reservoir in a water mass in the form of a rectangle, which dam embraces a number of contiguous storage compartments at least partly.

In such a storage device the natural oil products are mainly stored below surface level, which limits the fire hazard to a minimum. Manufacturing such a device in a water mass has the advantage that the required depth is already available, so that it is only necessary to level the bottom of the water mass to a desired extent. If a port is situated adjacent a river mouth the storage device can be built before one of the river banks, while it is also very well possible to build just before the coast or against the coast.

The storage compartments of the storage device may be defined on four sides by a common wall with adjacent compartments or with the dam. As compared to surface storage tanks, each of which is defined on all sides by an often cylindrical wall of its own, an enormous material saving is thus attained.

In an elaboration of the invention each boundry wall may be a caisson composed of two wall plates with spacer plates regularly distributed over the length, which are directed normal to the wall plate planes, the lower edge of the plates being sunk in the water mass bottom and the upper edge extending above water level, which caissons are filled up, for instance with sand. Filled up with sand or other bulk material, such caissons form a sturdy wall which is secured against lateral movements by connection at the upright terminal edges with caissons of the same and of adjacent compartments. The caissons can be manufactured on the bank and can be transported to their place of destination by means of a floating dock. According to the invention the vertical caisson wall edges can be welded both above and under water to adjacent edges of caisson walls which are directed normal thereto.

By constructing all caissons of a size, according to the invention, it is possible to work by a very simple building system, where each caisson can serve as a partition between two equally large and square compartments and wherein it is possible, using identical caissons and starting form one angle, to build up a draught-board of compartments, by each time securing three, two or one compartment wall to a series of completed compartments.

Furthermore according to the invention the dam protecting the series of compartments from the water, either river water or seawater, may be composed of compartments composed of either the same or of higher caissons, which are filled up, however, just as the caissons. Such a series of compartments arranged one behind the other, wherein the space between the walls of the caissons is filled up with sand and also the four compartments each time enclosed by the four caissons are entirely filled with sand, forms a strong dike body which, in an elaboration of the invention, can be completed on the water side with a sloping weir embankment of a shore or the like.

In order to keep the caissons always loaded on two sides each storage compartment may contain a layer of water above which there is an oil storage space, while pump installations may be provided which are operative over a number of compartments for controlling the water level on the dike or dam.

Each compartment may be provided with a floating roof and the oil supply and discharge can be controlled through electronic control equipment by means of transport conduits, in case of large compartment dimensions, terminating via a divider piece at the compartment corners and in the center.

If the storage device is to be placed entirely in open water, that is to say at a distance from a coast or lake shore, it is possible according to the invention to level a surface of the bottom of a water mass at a desired depth, to arrange on the levelled part four caissons vertically and perpendicularly with respect to each other, to interconnect the caissons at the upright edges both above and under water, to fill up the caissons and the compartment enclosed by the caissons, while a second compartment is built on to the first compartment by means of three caissons, so that both compartments have a common wall, and to also fill up this second compartment fully, to build a third compartment on to this second compartment etc. until one side of the rectangular dam wall has been completed, after which, normal to the edges of the completed dam wall, it is possible to start the manufacture of the contiguous rectangular sides of the dam, while after these two rectangular sides have been completed over a certain distance, it is possible to start, in the U-shaped inner space of the dam, composing the storage compartments from caissons, while building on the dam walls may take place simultaneously with the erection of the storage compartment walls.

If the oil storage device is to be built adjacent to a shore or bank, it is possible according to the invention to erect in the shallow part of the bank a vertical partition, for instance of plate iron, to bring the water side of the wall at the desired depth, to build further on to the iron wall a compartment from four caissons, to fill up the caissons and the compartment space, to build a second compartment with three caissons on the side of the first compartment directed away from the partition, said three caissons being contiguous to the first compartment etc. until the end is reached of a dam wall composed of the filled up compartments, while at the end of this dam wall directed substantially normal to the partition a dam wall is built extending parallel to the partition by means of similar compartments and on the end of said second dam wall another dam is built connecting said end to the partition, while after the completion of part of the dam wall extending padallel to the coast or partition provisions are made already for arranging storage compartments in the "lagoon" enclosed by the completed dam portion.

The invention will now be elucidated in more detail with reference to the drawings showing an embodiment of the storage device for liquids.

Figure 1:
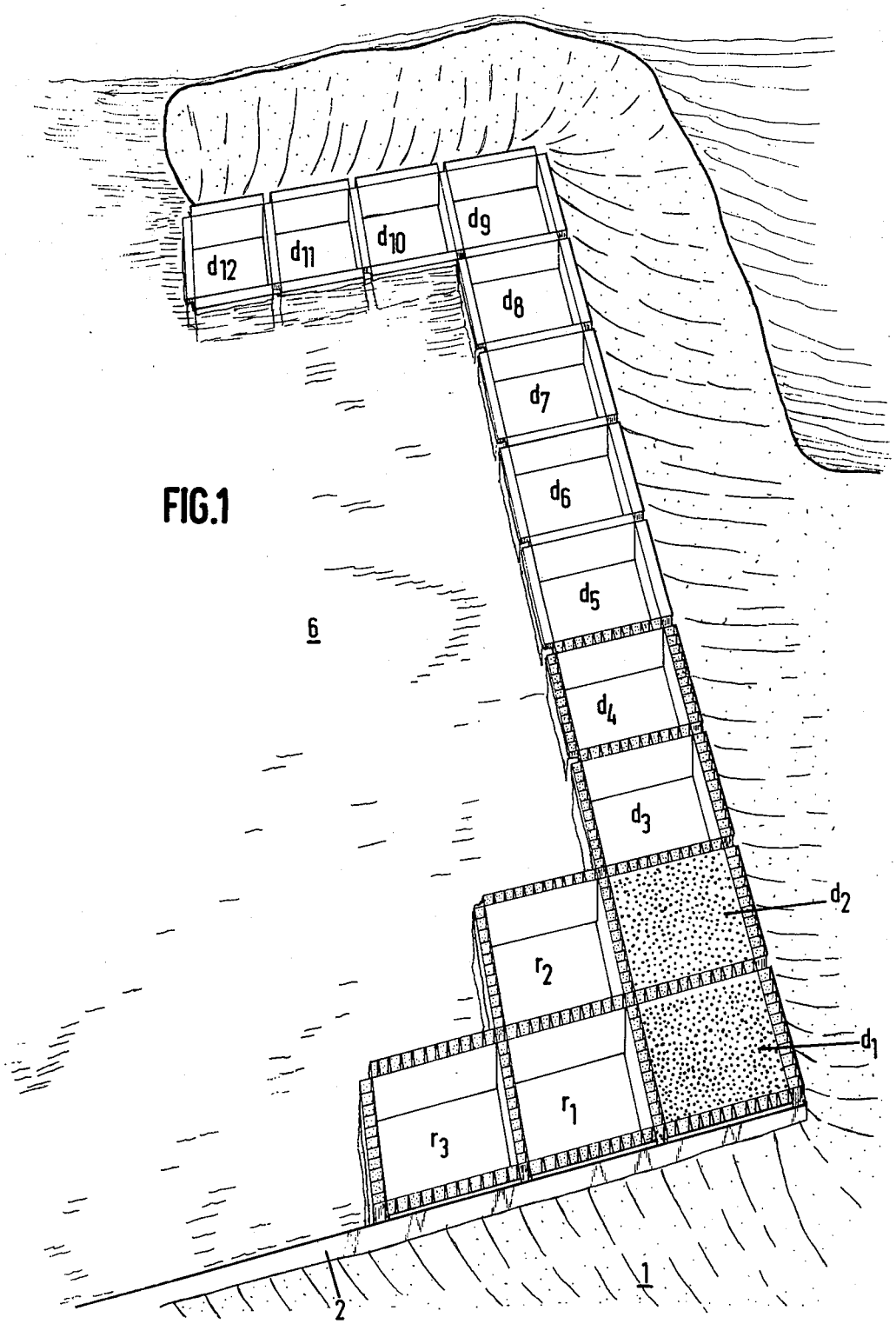
FIG. 1 shows a schematic perspective view of a storage device under construction.

As shown in the drawing, in particular FIG. 1, a start has been made with a storage device according to the invention before a shore, for instance on the beach 1. A partition 2, for example of plate steel, has been erected and on the seaside the sand of the beach has been dredged away to the desired depth of the reservoir.

Figure 3:
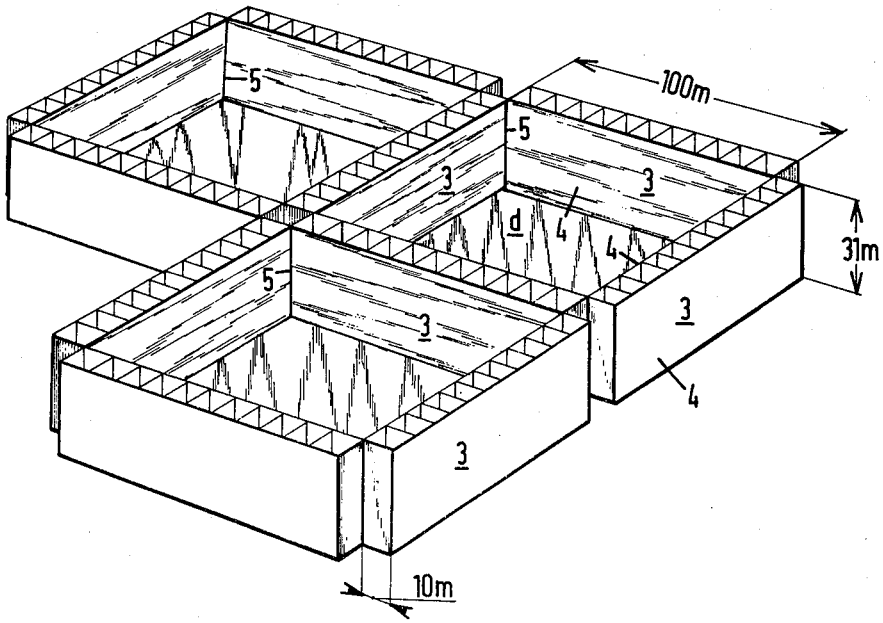
FIG. 3 shows in perspective view the principle of contiguous compartments.

After this the compartment $d_1$ has been erected, composed of four caissons 3, for the construction of which reference is made to FIG. 3.

Each caisson 3 is composed of two iron plates 4 having a thickness of for instance 8 mm, a height of 31 m and a length of 100 m. Two such plates are fixed in spaced relationship by iron partitions arranged vertically with a mutual distance of 10 m. By welding four such caissons 3 to each other at the edges 5 a compartment $d$ is obtained.

Each caisson is prepared on the shore and is subsequently vertically brought in position for instance with a floating derrick. On the place of the first compartment, where the sand bottom has been levelled for instance at a depth of 25 m, a first caisson is placed vertically. For instance by washing out the sand under the caisson, said caisson can be sunk a meter in the bottom and therefore extends with a height of 31 m, 30 m above the sea bottom. At a levelling depth of 25 m the caisson extends therefore 5 m above the water surface. In one or more compartments, which are defined by on the one hand the caisson wall plates and on the other the transverse partitions, so called spuds can be provided, consisting of tubular beams which may have been made heavier by a filling of for example sand. Such tubes are kept in upright condition by a latch on the upper side of the caisson, and as soon as the caisson has been put on its definitive place, the latches can be released and the spuds can shoot into the ground by way of anchoring poles. The space between the two plates 4 of each caisson 3 is filled with sand, which has become available for instance during levelling.

On a compartment $d$ or $r$ composed of four caissons a second compartment can be built by means of three caissons, a caisson 3 serving as a defining wall for the two caissons.

Figure 2:
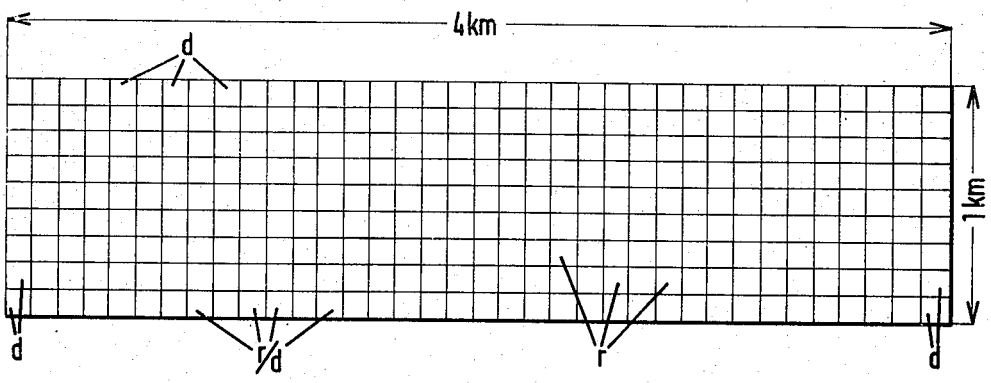
FIG. 2 is a schematic plan view of a completed storage device.

Building in this way, adding compartments to the existing compartments by means of three caissons, or dependent on the situation, two caissons and even under circumstances one caisson, a so-called draughtboard structure as shown in FIG. 2 is obtained.

As shown in FIG. 2 the oil storage device is defined on at least 3 sides by compartments $d$ and in the centre a number of storage compartments $r$ has been arranged, while along one rectangular side of the storage device compartments $r/d$ are provided. The difference between the compartments $d$, $r$ and $r/d$ will be entered into in greater detail in the following.

As appears from FIG. 1, not only the space in each caisson of the first compartment $d_1$ is filled with sand or other bulk material, but also the compartment space enclosed between each time four caissons.

Such a body fully filled with sand forms part of a dam and such dam compartments are shown in FIG. 2 by $d$.

After completion and filling with sand of the compartment $d_1$ (FIG. 1), the building of the storage device is continued with a compartment $d_2$, $d_3$ etc. up to and including $d_9$. As from compartment $d_9$ building is continued not normal to the shore, but parallel to the shore with compartments $d_{10}$, $d_{11}$ and $d_{12}$. All these compartments $d_1$–$d_{12}$ are entirely filled both in the caisson space and in the compartment space. The sand required can be obtained from the "lagoon" 6, in the lee of the hook-shaped dam body formed. On the seaside of the dam $d_1$–$d_{12}$ a wash weir can be formed of superfluous sand, possible covered with gravel.

The space 6 is now protected against the influence of the sea or river water, and can be levelled at the desired depth of for instance 25 $m$, while it is possible to start in the space 6 the arrangement of compartments $r$, which only differ from the compartments $d$ as regards function. The compartments $r$ are composed of caissons 3, just as the compartments $d$. The space in the caissons is also filled with sand or other bulk material, but the inner space serves as an oil reservoir.

It is now possible to simultaneously place storage compartments $r$ and to continue building on the breakwater $d_9$–$d_{12}$, by placing compartments $d_{13}$, $d_{14}$ etc.

FIG. 2 shows compartments by $r/d$. In an oil reservoir which is built against a shore or bank all compartments, except the dam compartments extending along three rectangular sides, can be utilized as reservoir. However, if the reservoir is built at some distance from a shore or bank it will be clear that the reservoir must be enclosed on all sides by dam walls. The compartments $r_1$, $r_3$ etc. (FIG. 1) will then also have to be filled with sand.

With the given depression of the sea bottom up to 25 m, with the caisson dimensions as described with reference to FIG. 3, with a useful filling height of 20 m in each compartment and with storage device dimensions as shown in FIG. 2, the storage device being surrounded on four sides by dam reservoirs, the storage device has a capacity of 47,600,000 $m^3$.

It will be clear that with such dimensions receiving the contents of a so-called mammoth tanker does not produce any problem. For example finger piers may be provided contiguous to the dam walls for mooring such large ships. On the dike, which has a width of 100 m, all possible provisions may be made, such as the construction of pumping stations, the construction of roads, possibly track rails, beacons and the like.

The production of a great number of drillings on a continental shelf, oil supplied via pipe lines and also other substances to be stored for a shorter or linger time can be received in such a large reservoir without any objection.

The internal construction of the storage reservoirs can be varied in all manners possible. Each reservoir may be provided for instance with a floating roof, with means for forming a separation between the water present in the reservoir and the oil floating thereon, briefly all measures which are also applied in surface storage reservoirs for natural oil products.

I claim:

1. A method of manufacturing out of a plurality of caissons an installation for storing petroleum products or the like in a water mass near a shore, each caisson comprising a pair of vertically upstanding horizontally spaced walls with a plurality of cross members therebetween, said method comprising the steps of:

a. levelling a bottom surface of a water mass at a predetermined depth to form a level surface;

b. arranging four of said caissons in edge to edge relationship, adjacent caissons perpendicular to each other, on said levelled surface;

c. interconnecting said four caissons at upright edges thereof both above and below the water surface to form a first box-like rectangular or square compartment;

d. filling the area between the spaced upstanding walls of each of said caissons and said first box-like compartment with sand;

e. building a second box-like rectangular or square compartment attached to said first compartment by means of three additional caissons so that said first and second compartments have a common wall;

f. filling the spaces between the upstanding walls of each of said additional caissons and said second compartment with sand;

g. repeating steps (a) – (f) until a dam wall extending generally parallel to said shore is completed;

h. repeating steps (a) – (f) until two rectangular side walls are formed extending a predetermined distance from said dam wall toward the shore so that a U-shaped storage region is formed; and i. erecting a plurality of box-like rectangular or square storage compartments within said storage region by arranging a plurality of caissons on a levelled bottom surface of said storage region in edge to edge relationship, having common caisson-walls with said dam wall and said side walls and with each other, and filling with sand the area between the spaced upstanding walls of each of said caissons.

2. A method as recited in claim 1 comprising the further step of erecting a vertical partition in said shore, said rectangular side walls extending generally perpendicularly thereto, and a plurality of storage compartment caissons being disposed thereagainst.

3. An installation for storing petroleum products or the like in a water mass, having a floor, near a shore, said installation comprising a. a plurality of caissons, each of said caissons having a pair of vertically upstanding horizontally spaced walls with a plurality of cross members therebetween, and sand filling the space between said upstanding walls, each caisson having the bottom thereof disposed in the water mass floor and the top thereof extending out of the water surface, b. a plurality of first box-like rectangular or square compartments formed from a plurality of said caissons, each compartment formed by four caissons arranged in edge to edge relationship, adjacent caissons perpendicular to each other, and adjacent compartments having a caisson-wall thereof in common, c. a plurality of said compartments forming a dam wall extending generally parallel to said shore and a plurality of said compartments forming a pair of side walls extending generally perpendicular to said dam wall and toward said shore, and said dam wall and said side walls enclosing a storage region, all of said compartments filled with sand, and d. a plurality of second box-like rectangular or square compartments formed from a plurality of said caissons, said compartments being disposed in said storage region and having caisson-walls common with said dam wall and said side walls, and with each other, said compartments containing natural oil products or the like therein.

4. An installation as recited in claim 3 further comprising a vertical partition in said shore and generally perpendicular to said installation side walls, a plurality of said storage compartment caissons being disposed thereagainst.

5. An installation as recited in claim 3 wherein each of said storage compartments contains a layer of water therein, said natural oil products or the like floating on said layer of water.

* * * * *